US012104474B2

(12) United States Patent
Adams et al.

(10) Patent No.: US 12,104,474 B2
(45) Date of Patent: Oct. 1, 2024

(54) ELECTRIC SUBMERSIBLE PUMP

(71) Applicant: ARAMCO SERVICES COMPANY, Houston, TX (US)

(72) Inventors: Robert Adams, Houston, TX (US); Vijay Ramakrishnan, Houston, TX (US); Max Deffenbaugh, Houston, TX (US)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 189 days.

(21) Appl. No.: 17/820,145

(22) Filed: Aug. 16, 2022

(65) Prior Publication Data

US 2024/0060403 A1 Feb. 22, 2024

(51) Int. Cl.

| | |
|---|---|
| ***E21B 43/12*** | (2006.01) |
| ***E21B 47/008*** | (2012.01) |
| ***E21B 49/08*** | (2006.01) |
| ***F04B 47/06*** | (2006.01) |
| ***F04B 49/08*** | (2006.01) |

(52) U.S. Cl.

CPC ..... *E21B 43/128* (2013.01); *E21B 47/008* (2020.05); *E21B 49/0875* (2020.05); *F04B 47/06* (2013.01); *F04B 49/08* (2013.01)

(58) Field of Classification Search

CPC .. E21B 43/128; E21B 47/008; E21B 49/0875; F04B 47/06; F04B 49/08; F04B 2203/0202; F04B 2203/0208

See application file for complete search history.

(56) References Cited

U.S. PATENT DOCUMENTS 6,354,147 B1 * 3/2002 Gysling ..... G01N 29/024 73/61.79
7,526,966 B2 * 5/2009 Gysling ..... G01F 1/667 73/861.23

(Continued)

FOREIGN PATENT DOCUMENTS

CA 2686688 C * 6/2012 ..... F04B 51/00

OTHER PUBLICATIONS

"Downhole ESP Sensors;" Aug. 15, 2022; pp. 1-6; Retrieved from the Internet: URL: https://www.novometgroup.com/products-services/artificial-lift/downhole-sensor-systems/ (6 pages).

(Continued)

*Primary Examiner* — Dominick L Plakkoottam
(74) *Attorney, Agent, or Firm* — Osha Bergman Watanabe & Burton LLP

(57) ABSTRACT

An electric submersible pump (ESP), comprising: an intake that suctions fluids into the ESP, wherein the fluids include a mixture of gas, water, and oil; a discharge that discharges the fluids from the ESP; an acoustic intake transducer that determines the speed of sound in the fluids suctioned into the ESP at the intake; and a first acoustic discharge transducer that determines the speed of sound in the fluids discharged from the ESP, wherein the speed of sound of the fluid at both intake and discharge is used to calculate a gas volume fraction difference of the multiphase fluid mixture across the intake and discharge of the pump, and wherein the gas volume fraction difference is used as feedback to control the ESP.

18 Claims, 3 Drawing Sheets

(56) References Cited

U.S. PATENT DOCUMENTS

| | | | | |
|---|---|---|---|---|
| 7,725,270 | B2 * | 5/2010 | Davis | G01F 15/0755 702/45 |
| 7,784,538 | B2 * | 8/2010 | McCoy | E21B 43/121 166/250.03 |
| 10,415,373 | B2 | 9/2019 | Clarke et al. | |
| 10,480,308 | B2 | 11/2019 | Morrow et al. | |
| 11,125,909 | B2 * | 9/2021 | Farhadiroushan | G01V 11/00 |
| 2002/0152802 | A1 * | 10/2002 | Gysling | G01N 29/024 73/61.79 |
| 2003/0084707 | A1 * | 5/2003 | Gysling | G01N 9/002 73/32 R |
| 2003/0136186 | A1 * | 7/2003 | Gysling | G01N 9/24 73/32 A |
| 2008/0006089 | A1 * | 1/2008 | Adnan | G01M 3/24 417/63 |
| 2012/0034103 | A1 * | 2/2012 | Bartenev | E21B 43/128 417/1 |
| 2013/0324954 | A1 * | 12/2013 | Friedrich | A61M 1/743 604/319 |
| 2014/0269144 | A1 * | 9/2014 | Ayo | B01F 35/2134 366/8 |
| 2016/0041286 | A1 * | 2/2016 | Sinha | G01F 1/74 73/152.32 |
| 2017/0016312 | A1 * | 1/2017 | Clarke | E21B 47/135 |
| 2017/0038496 | A1 * | 2/2017 | Kischkat | E21B 49/00 |
| 2017/0321549 | A1 * | 11/2017 | Erdmann | E21B 49/086 |
| 2018/0266240 | A1 * | 9/2018 | Jaaskelainen | E21B 49/08 |
| 2021/0164337 | A1 * | 6/2021 | Mannai | E21B 47/00 |
| 2021/0164341 | A1 | 6/2021 | Pfutzner et al. | |
| 2021/0301813 | A1 * | 9/2021 | Armacanqui | E21B 47/008 |
| 2022/0250950 | A1 * | 8/2022 | Bergstrom | B01D 61/025 |
| 2022/0260530 | A1 * | 8/2022 | Al-Huwaider | G01N 29/222 |

OTHER PUBLICATIONS

"Phoenix CTS Cable-to-surface artificial lift downhole monitoring system;" Aug. 15, 2022; pp. 1-2; Retrieved from the Internet: URL: https;//www.slb.com/-/media/files/al/product-sheet/phoenix-cts-ps.ashx (2 pages).

"Spectrum ESP Downhole Monitoring System;" Aug. 15, 2022; pp. 1-2; Retrieved from the Internet: URL: https://www.alkhorayefpetroleum.com/alkhorayef/media/alkhorayefmedia/pdf/spectrum-downhole-monitoring-system.pdf (2 pages).

* cited by examiner

ELECTRIC SUBMERSIBLE PUMP

BACKGROUND

The first stage of hydrocarbon production, also called primary production, is for displacing hydrocarbons from the reservoir into the wellbore and up to the surface by natural reservoir energy, such as gasdrive, waterdrive, or gravity drainage. Initially, the reservoir pressure is higher than the pressure at the bottom of the wellbore. This differential pressure drives hydrocarbons toward the well and up to the surface. Hydrocarbon production lowers the reservoir pressure, and consequently the differential pressure. To increase the hydrocarbon production, an artificial lift system, such as a rod pump, an electrical submersible pump (ESP), or a gas-lift installation, is used. The primary production declines either when the reservoir pressure is so low that the production rates are not economical, or when the proportions of gas or water in the production stream are too high.

The second stage of hydrocarbon production, also called secondary production, sustains the hydrocarbon production at viable rates when the flow rate of the primary production declines. The secondary production also involves an ESP or reservoir injection for pressure maintenance. During secondary production from an oil well, the ESP system is added to the completion string downhole in order to increase the pressure of the downhole fluids, such that hydrocarbons can be produced and recovered on the surface.

The fluids pumped through the ESP are often a multiphase mixture of oil, gas, and water. The presence of gas flowing through the ESP can cause a reduction in liquid production efficiency, degrade the power efficiency of the pumping system, and lead to early failures of the downhole pump. If the amount of gas in the multiphase fluid mixture is allowed to increase without a source of feedback controlling the ESP operation, detrimental pumping situations may occur, such as: gas breakout, gas surging, and gas locking of the pump system.

Existing ESP monitoring systems monitor the surface power and the motor load for a specified rotational speed and driving voltage and relate changes in motor load to changes in the system downhole. Motor load changes happen for many reasons, such as ESP degradation, and fluid mixture changes. Changes in gas content are not inferred from the surface measurements. Downhole ESP sensor systems monitor intake pressure, intake temperature, motor temperature, discharge pressure, three-axis vibration, and motor cable current leakage. These sensor packages measure motor characteristics and infer motor health and fluid composition. They do not directly measure gas content, and therefore cannot control pump operation to limit the amount of the gas content. The ESP has lower efficiencies if gas fractions are greater than about 10% by volume at the pump intake.

Accordingly, there exists a need for an ESP that measures the gas content in fluids flowing through the ESP with significant sensitivity to effectively control the operation of the ESP.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to an electric submersible pump (ESP), comprising: an intake that suctions fluids into the ESP, wherein the fluids comprise a mixture of gas, water, and oil; a discharge that discharges the fluids from the ESP; an acoustic intake transducer that determines the speed of sound in the fluids suctioned into the ESP at the intake; and a first acoustic discharge transducer that determines the speed of sound in the fluids discharged from the ESP, wherein the speed of sound of the fluid at both intake and discharge is used to calculate a gas volume fraction difference of the multiphase fluid mixture across the intake and discharge of the pump, and wherein the gas volume fraction difference is used as feedback to control the ESP.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Embodiments disclosed herein describe a method and apparatus to monitor the gas volume fraction difference of the multiphase fluid mixture across the intake and discharge of an ESP. The measured gas volume fraction difference can then be used as a source of feedback to control the operation of the ESP, minimizing the breakout of gas and occurrence of gas surging/locking. In one aspect, embodiments disclosed herein relate to an electric submersible pump (ESP), including: a downhole pump that adds pressure to downhole fluids of a well, an intake that suctions the fluids into the ESP, a discharge that discharges the fluids from the ESP, and a first acoustic discharge transducer that determines the speed of sound in the fluids discharged from the ESP.

Embodiments of the present disclosure may provide at least one of the following advantages. The ESP continuously monitors the downhole gas content, in gas volume fraction, and controls the motor of the ESP to prevent gas surging and gas locking.

Figure 1:
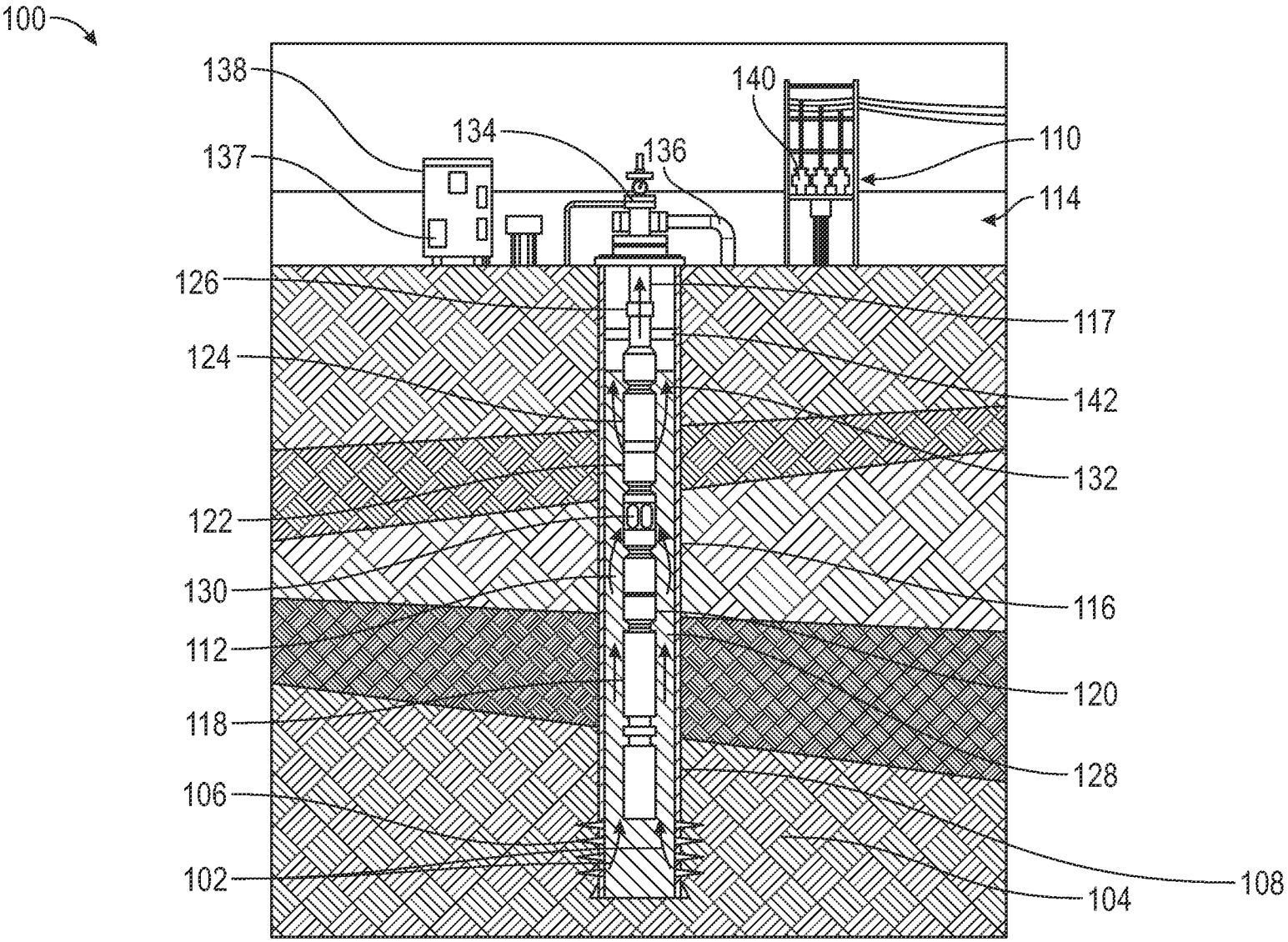
FIG. 1 shows an exemplary ESP, according to one or more embodiments.

FIG. 1 shows an exemplary Electrical Submersible Pump (ESP) 100. The ESP 100 is one example of an artificial lift system that is used to help produce fluids 102 from a formation 104. Perforations 106 in the well's 116 casing string 108 provide a conduit for the produced fluids 102 to enter the well 116 from the formation 104. An ESP 100 is an example of the artificial lift system, ESP and artificial lift system may be used interchangeably within this disclosure. The ESP 100 includes surface equipment 110 and an ESP string 112. The ESP string 112 is deployed in a well 116 and the surface equipment 110 is located on the surface 114. The surface 114 is any location outside of the well 116, such as the Earth's surface.

The ESP string 112 may include a motor 118, motor protectors 120, a gas separator 122, a multi-stage centrifugal pump 124 (herein called a "pump" 124), and an electrical cable 126. The ESP string 112 may also include various pipe segments of different lengths to connect the components of the ESP string 112. The motor 118 is a downhole submersible motor 118 that provides power to the pump 124. The motor 118 may be a two-pole, three-phase, squirrel-cage induction electric motor 118. The motor's 118 operating voltages, currents, and horsepower ratings may change depending on the requirements of the operation.

The size of the motor 118 is dictated by the amount of power that the pump 124 requires to lift an estimated volume of produced fluids 102 from the bottom of the well 116 to the surface 114. The motor 118 is cooled by the produced fluids 102 passing over the motor housing. The motor 118 is powered by the electrical cable 126. The electrical cable 126 may also provide power to downhole pressure sensors or onboard electronics that may be used for communication. The electrical cable 126 is an electrically conductive cable that is capable of transferring information. The electrical cable 126 transfers energy from the surface equipment 110 to the motor 118. The electrical cable 126 may be a three-phase electric cable that is specially designed for downhole environments. The electrical cable 126 may be clamped to the ESP string 112 in order to limit electrical cable 126 movement in the well 116. In further embodiments, the ESP string 112 may have a hydraulic line that is a conduit for hydraulic fluid. The hydraulic line may act as a sensor to measure downhole parameters such as discharge pressure from the outlet of the pump 124.

Motor protectors 120 are located above (i.e., closer to the surface 114) the motor 118 in the ESP string 112. The motor protectors 120 are a seal section that houses a thrust bearing. The thrust bearing accommodates axial thrust from the pump 124 such that the motor 118 is protected from axial thrust. The seals isolate the motor 118 from produced fluids 102. The seals further equalize the pressure in the annulus 128 with the pressure in the motor 118. The annulus 128 is the space in the well 116 between the casing string 108 and the ESP string 112. The pump intake 130 is the section of the ESP string 112 where the produced fluids 102 enter the ESP string 112 from the annulus 128.

The pump intake 130 is located above the motor protectors 120 and below the pump 124. The depth of the pump intake 130 is designed based off of the formation 104 pressure, estimated height of produced fluids 102 in the annulus 128, and optimization of pump 124 performance. If the produced fluids 102 have associated gas, then a gas separator 122 may be installed in the ESP string 112 above the pump intake 130 but below the pump 124. The gas separator 122 removes the gas from the produced fluids 102 and injects the gas (depicted as separated gas 132 in FIG. 1) into the annulus 128. If the volume of gas exceeds a designated limit, a gas handling device may be installed below the gas separator 122 and above the pump intake 130.

The pump 124 is located above the gas separator 122 and lifts the produced fluids 102 to the surface 114. The pump 124 has a plurality of stages that are stacked upon one another. Each stage contains a rotating impeller and stationary diffuser. As the produced fluids 102 enter each stage, the produced fluids 102 pass through the rotating impeller to be centrifuged radially outward gaining energy in the form of velocity. The produced fluids 102 enter the diffuser, and the velocity is converted into pressure. As the produced fluids 102 pass through each stage, the pressure continually increases until the produced fluids 102 obtain the designated discharge pressure and has sufficient energy to flow to the surface 114.

In other embodiments, sensors may be installed in various locations along the ESP string 112 to gather downhole data such as pump intake volumes, discharge pressures, shaft speeds and positions, and temperatures. The number of stages is determined prior to installation based of the estimated required discharge pressure. Over time, the formation 104 pressure may decrease and the height of the produced fluids 102 in the annulus 128 may decrease. In these cases, the ESP string 112 may be removed and resized. Once the produced fluids 102 reach the surface 114, the produced fluids 102 flow through the wellhead 134 into production equipment 136. The production equipment 136 may be any equipment that can gather or transport the produced fluids 102 such as a pipeline or a tank.

The remainder of the ESP 100 includes various surface equipment 110 such as electric drives 137, production controller 138, the control module, and an electric power supply 140. The electric power supply 140 provides energy to the motor 118 through the electrical cable 126. The electric power supply 140 may be a commercial power distribution system or a portable power source such as a generator. The production controller 138 is made up of an assortment of intelligent unit-programmable controllers and drives which maintain the proper flow of electricity to the motor 118 such as fixed-frequency switchboards, soft-start controllers, and variable speed controllers. The production controller 138 may be a variable speed drive (VSD), well choke, inflow control valve, and/or sliding sleeves. The production controller 138 is configured to perform automatic well operation adjustments. The electric drives 137 may be variable speed drives which read the downhole data, recorded by the sensors, and may scale back or ramp up the motor 118 speed to optimize the pump 124 efficiency and production rate. The electric drives 137 allow the pump 124 to operate continuously and intermittently or be shut-off in the event of an operational problem.

Figure 2:
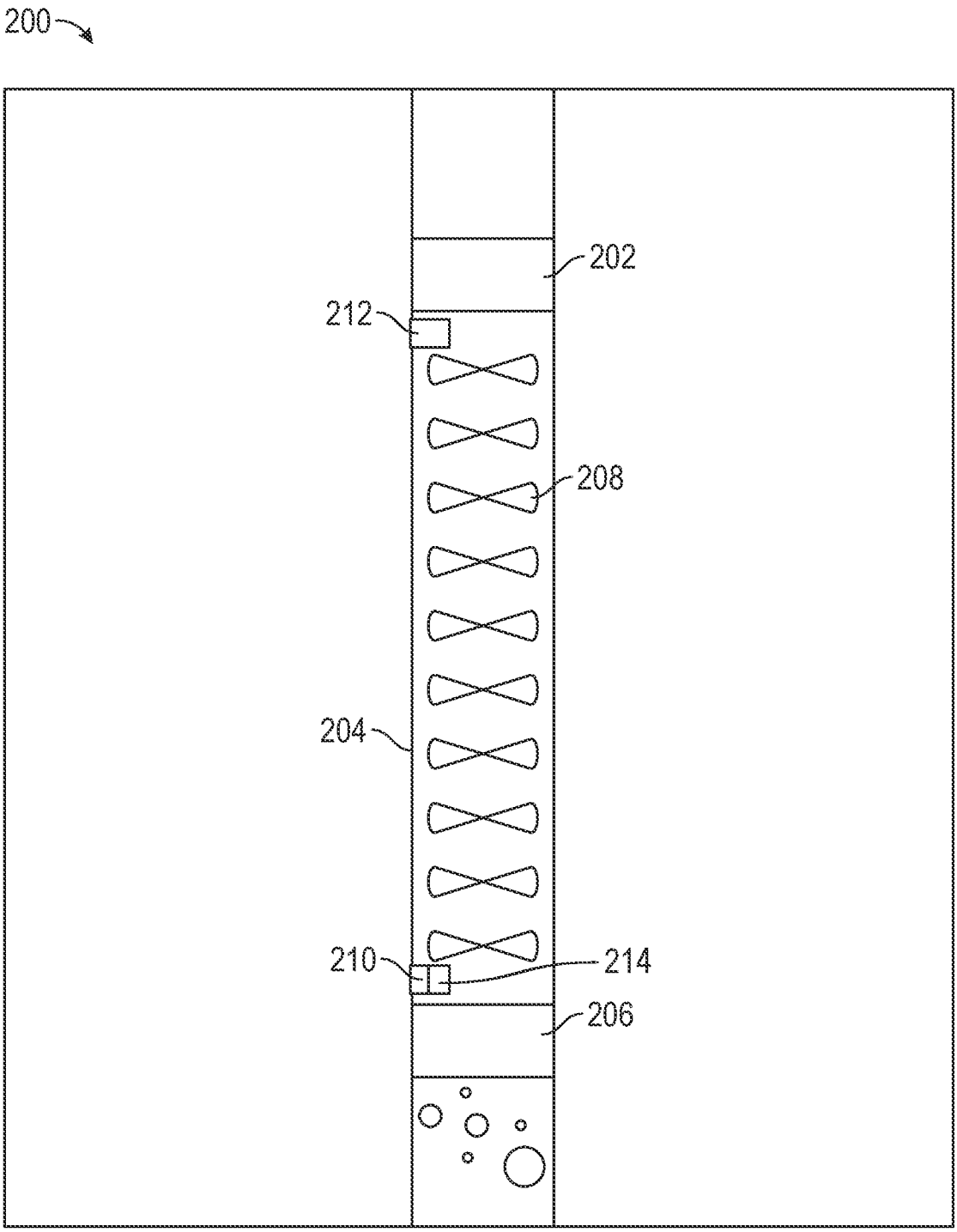
FIG. 2 shows a magnification of the body of the ESP, according to one or more embodiments.

FIG. 2 shows a magnification of the body of the ESP 200 for sensing an acoustic gas breakout. The ESP 200 comprises an intake 206 that suctions the fluids, a tubular body 204 for transferring the fluids, and a discharge 202 for discharging the fluids. The tubular body 204 connects the discharge 202 with the intake 206. In one or more embodiments, the fluid is a multiphase fluid mixture.

The discharge 202 is disposed at the top end of the ESP 200 and includes an acoustic discharge transducer 210 to measure the speed of sound in the fluids discharged from the ESP 200. The acoustic discharge transducer 210 may be in direct contact with the fluids or indirect contact with the fluids and still measure the speed of sound in the fluids. In some embodiments, a pressure-based density sensor 214 is disposed next to, or in the vicinity of, the acoustic discharge transducer 210. In other embodiments, the pressure-based density sensor 214 is attached to the acoustic discharge transducer 210. In one or more embodiments, the ESP 200 also measures a pressure-based density of the fluids discharged from the ESP 200 via changes in the measured speed of sound through the fluid, or through the additional pressure-based density sensor 214, such as a differential pressure measurement across a fixed column height through which the density of the fluid column is derived.

The intake 206 is disposed at the bottom end of the ESP 200 and includes an acoustic intake transducer 212 to measure the speed of sound in the fluids suctioned into the ESP 200.

The ESP 200 includes surface components, housed in the production facility, such as an oil platform, and sub-surface components disposed downhole. Surface components include the motor controller, in particular a variable speed controller, surface cables, and transformers. The subsurface components are attached to the downhole end of a tubing string and then lowered into the well bore along with the tubing.

At the surface, a high-voltage alternating-current source delivering 3 to 5 kV drives the subsurface motor. An electric cable extends from the source to the motor. This cable is wrapped around jointed tubing and connected at each joint. In one or more embodiments, coiled tubing umbilicals allow for both the piping and electric cable to be deployed within a single unit. In one or more embodiments, cables for sensor and control data are included in the coiled tubing umbilicals.

The ESP 200 is a lift system comprising an electrically driven downhole pump that further comprises several staged centrifugal pump sections that adds pressure to the downhole fluids from the well to be controlled by the output of a controller.

The motor rotates a shaft that, in turn, rotates pump impellers 208 to lift the fluids through the tubular body 204 to the surface. The ESP 200 works at high temperatures of up to 300° F. (149° C.) and high pressures of up to 5,000 psi (34 MPa), from deep wells of up to 12,000 feet (3.7 km) deep with high energy requirements of up to 1000 horsepower (750 kW).

The pump itself is a multi-stage pump, wherein the number of stages are determined by the operating requirements, such as the depth of the well. Each stage includes an impeller 208 and diffuser. Each impeller 208 is coupled to the rotating shaft and accelerates fluid upwards. The fluid then enters a non-rotating diffuser, which is not coupled to the shaft and contains vanes that direct fluid back toward the shaft. The motor used to drive the pump is a three-phase, squirrel cage induction motor, with a nameplate power rating in the range 7.5 kW to 560 kW, at 60 Hz.

The ESP 200 also includes seals coupled to the shaft between the motor and the pump, screens to reject sand, and fluid separators at the pump intake that separate gas, oil, and water. In some embodiments, the ESP 200 includes a water/oil separator which permits water to be re-injected downhole.

Figure 3:
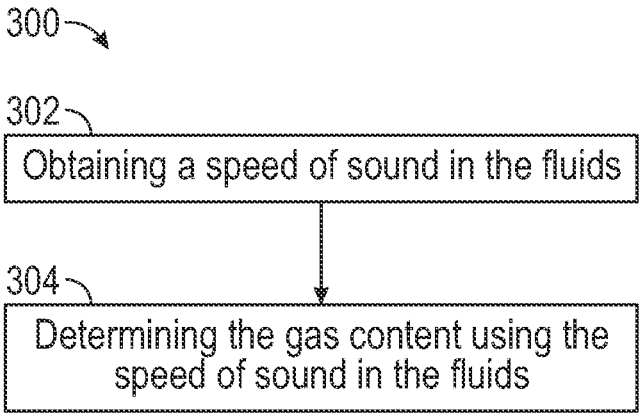
FIG. 3 shows a flowchart of the method steps for determining a gas content in fluids transported by an ESP, according to one or more embodiments.

FIG. 3 shows a flowchart of the method steps for determining a gas content in fluids transported by the ESP.

In step 302, the speed of sound in fluids exiting the ESP is obtained.

In one or more embodiments, a single acoustic discharge transducer is used to determine the speed of sound in the discharged fluid. The single acoustic discharge transducer emits an acoustic pulse into the fluids, which is reflected at the surface of the fluids, and impinged on the single acoustic discharge transducer. The time of flight of the acoustic pulse is measured by the single acoustic transducer. The speed of sound c in the fluids is the ratio of the time of flight $\Delta t$ of the acoustic pulse and the known distance D between the single acoustic discharge transducer and the reflector: $c=2\ D/\Delta t$.

In other embodiments, two or more acoustic discharge transducers are used to determine the speed of sound in the discharged fluids. One of the acoustic discharge transducers transmits an acoustic pulse into the discharged fluids, which impinges on another (receiver) acoustic discharge transducer. The speed of sound c in the fluids is the ratio of the time of flight of the acoustic pulse $\Delta t$ and the known distance D between the transmitter and receiver acoustic transducers: $c=D/\Delta t$.

Assuming a homogenous distribution of the liquid and gas phases in the fluids, the measured speed of sound c D in the fluids at the discharge of the ESP is:

$$\frac{1}{c_D^2} = (\phi_{LD}\rho_L + \phi_{GD}\rho_G)\left(\frac{\phi_{LD}}{\rho_L c_L^2} + \frac{\phi_{GD}}{\rho_G c_G^2}\right)$$

where $\phi_{LD}$ is the volume fraction of the liquid phases, $\phi_{GD}$ is the volume fraction of the gas phases, $\rho_i$ is the density of the i-th fluid phase, $\phi_{iD}$ is the volume fraction of the i-th fluid phase, and $c_i$ is the speed of sound in the i-th fluid phase, $c_L$ is the speed of sound in the liquid phase, and $c_G$ is the speed of sound in the gas phase.

The volume fraction of the liquid and gas phases are interrelated: $1=\phi_{LD}+\phi_{GD}$ The speed of sound in the liquid phase $c_L$ is unknown and depends on the process conditions and the downhole oil/water ratio.

In downhole conditions with typical densities and speeds of sound, the inversely dependent term of the speed of sound in liquids is much less sensitive to changes in the density and speed of sound in the oil/water mixture than the inversely dependent term of the speed of sound in gasses, such that:

$$\Delta\frac{1}{\rho_L c_L^2} \ll \Delta\frac{1}{\rho_G c_G^2}.$$

Similarly, the liquid phase density $\rho_L$ is much larger than the gas phase density: $\rho_L >> \rho_G$. Thus, a simple density measurement of the liquids is performed at the discharge and relates the measured density to an assumed speed of sound in the fluids, with minimal error added to the calculation. The density of the liquids and a correlated speed of sound in the liquids is measured with a pressure-based density sensor at the discharge of the ESP, where $P_D(\rho)\propto\phi_{LD}\rho_L+\phi_{GD}\rho_G\approx\rho_L$, and $c_L\propto\rho_L$.

This measurement of the density of the liquids is more accurate at the discharge of the ESP, as the ESP favorably produces the liquid phase over the gas phase. The intake of the ESP has a higher gas content, and thus adds more error to the proportional measurement of the density of the liquids from the intake pressure.

The density and speed of sound in the gas phase are much less sensitive to changes in gas composition, temperature, and pressure than the liquid phase. Values of the gas phase density $\rho_G$ and the speed of sound in the gas phase $c_G$ are assumed with minimal error added to the calculation.

With these assumptions, the measured speed of sound in the fluids at the discharge simplifies to:

$$\frac{1}{c_D^2} = [(1-\phi_{GD})\rho_L + \phi_{GD}\rho_G]\left[\frac{(1-\phi_{GD})}{\rho_L c_L^2} + \frac{\phi_{GD}}{\rho_G c_G^2}\right]$$

The unknown terms, liquid phase density $\rho_L$ and speed of sound in the liquid phase $c_L$, are derived from the pressure-based density measurement at the discharge of the ESP, and the unknown terms gas phase density $\rho_G$ and speed of sound in the gas phase $c_G$ are assumed values a-priori. The gas content at the discharge $\phi_{GD}$ is then computed from the measured speed of sound at the ESP discharge. In another embodiment, a water-liquid ratio may be a known input parameter, and hence $\rho_L$ and $c_L$ may be known a-priori. The gas content at the discharge is then computed in a similar manner.

In step 304, a gas content of the fluids is determined using the speed of sound in the fluids exiting the ESP.

For determining the gas content of the fluids, the ESP comprises a controller that is connected to the acoustic discharge transducer. The acoustic discharge transducer determines the speed of sound in the fluids discharged from the ESP by measuring the time of flight of an acoustic pulse propagating through the fluids discharged from the ESP.

The difference in the measured gas volume fraction, which is calculated by $\Delta\phi_G=\phi_{GI}-\phi_{GD}$, is then used as a source of feedback for the operation of the ESP motor. Operation of the motor, whether it be a change in rotational speed or delivered electrical power, may then be tuned to minimize the gas volume fraction difference measured across the tubular body of the ESP, minimizing the occurrence of gas surging and gas locking, and ensuring the ESP system operates at peak efficiency.

Figure 4:
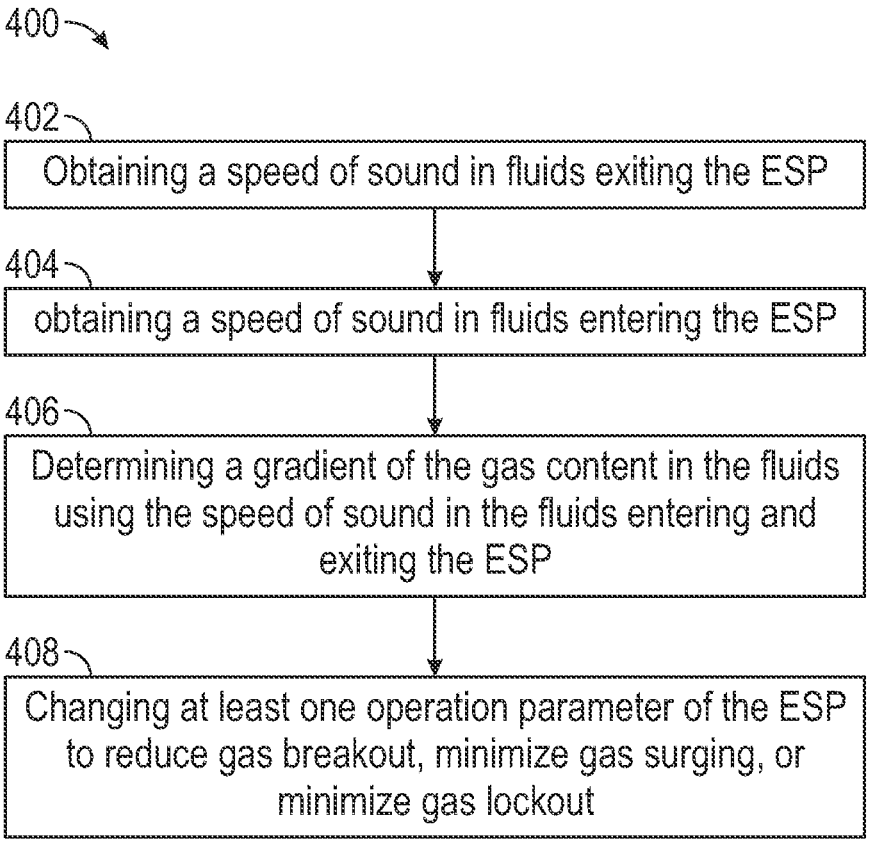
FIG. 4 shows another flowchart of the method steps for determining a gas content in fluids transported by the ESP.

FIG. 4 shows another flowchart 400 of the method steps for determining a gas content in fluids transported by the ESP.

In step 402, a speed of sound is obtained in fluids exiting the ESP. The speed of sound in fluids exiting the ESP is obtained as described in step 202 of FIG. 2.

In step 404, a speed of sound is obtained in fluids entering the ESP.

The controller of the ESP uses one or more acoustic transducers to measure the speed of sound in the fluids suctioned into the ESP. This measurement can be accomplished in the same way as the measurement at the ESP discharge. The measured speed of sound in the fluids at the intake is:

$$\frac{1}{c_I^2} = [(1-\phi_{GI})\rho_L + \phi_{GI}\rho_G]\left[\frac{(1-\phi_{GI})}{\rho_L c_L^2} + \frac{\phi_{GI}}{\rho_G c_G^2}\right]$$

The mixture of oil and water in the liquid phase will not change between the discharge and intake of the ESP, and thus the densities and speeds of sound of the liquid and gas phases used in the discharge measurement are also used in the intake measurement. The gas volume fraction at the discharge $\phi_{GI}$ is then computed from the measured speed of sound in fluids at the intake of the ESP.

In step 406, a gradient of the gas content in the fluids is determined using the speed of sound in the fluids entering and exiting the ESP.

In step 408, at least one operation parameter of the ESP is changed to reduce gas breakout, minimize gas surging, or minimize gas lockout. In one or more embodiments, the operation parameter comprises power, load, rotational speed, and driving voltage of the ESP.

The controller of the ESP 100 monitors the gas content of the fluids between a discharge and an intake of the ESP 100. The measured gas content may then be used as a source of feedback to control the operation of the ESP 100, minimizing the breakout of gas, and occurrence of gas surging and gas locking.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed:

1. An electric submersible pump (ESP), comprising:

an intake that suctions fluids into the ESP, wherein the fluids comprise a mixture of gas, water, and oil;

a discharge that discharges the fluids from the ESP;

an acoustic intake transducer that determines the speed of sound in the fluids suctioned into the ESP at the intake; and a first acoustic discharge transducer that determines the speed of sound in the fluids discharged from the ESP, wherein the speed of sound of the fluid at both intake and discharge is used to calculate a gas volume fraction difference of the multiphase fluid mixture across the intake and discharge of the pump, and wherein the gas volume fraction difference is used as feedback to control the ESP.

2. The ESP according to claim 1, wherein operation of the ESP is controlled using the gas volume fraction difference to reduce gas breakout, minimize gas surging, and minimize gas lockout.

3. The ESP according to claim 1, further comprising a density acoustic discharge transducer that measures a pressure-based density of the fluids discharged from the ESP.

4. The ESP according to claim 1, further comprising a second acoustic discharge transducer, wherein the first and second acoustic discharge transducer determine the speed of sound in the fluids discharged from the ESP.

5. The ESP according to claim 1, further comprising a second acoustic intake transducer, wherein the first and second acoustic intake transducer determine the speed of sound in the fluids discharged from the ESP.

6. The ESP according to claim 1, wherein the first acoustic discharge transducer is a mechanical transducer that converts sound waves into mechanical signals or vice versa.

7. The ESP according to claim 1, wherein the first acoustic discharge transducer is an electrical transducer that converts sound waves into electrical signals.

8. The ESP according to claim 7, wherein the first acoustic discharge transducer is a linear variable differential transformer that measures displacement or position changes by an electrical signal.

9. The ESP according to claim 1, further comprising a pressure-based density sensor at the discharge of the ESP that measures a pressure-based density of the fluids discharged from the ESP.

10. A method for determining a gas content in fluids transported by an ESP, comprising:

obtaining a speed of sound in the fluids, wherein the fluids comprise a mixture of gas, water, and oil;

determining the gas content using the speed of sound in the fluids; and feeding back the determined gas content to control operation of the ESP, wherein the speed of sound in the fluids exiting the ESP is determined.

11. The method according to claim 10, further comprising:

obtaining a speed of sound in fluids entering the ESP, and determining a gradient of the gas content in the fluids using the speed of sound in the fluids entering and exiting the ESP.

12. The method according to claim 10, further comprising:

changing at least one operation parameter of the ESP based on the determined gas content to reduce gas breakout, minimize gas surging, or minimize gas lockout.

13. The method according to claim 12, wherein the at least one operation parameter of the ESP comprises power, load, rotational speed, and driving voltage of the ESP.

14. The method according to claim 10, wherein the speed of sound in the fluids exiting the ESP is determined by $$\frac{1}{c_D^2} = [(1-\phi_{GD})\rho_L + \phi_{GD}\rho_G]\left[\frac{(1-\phi_{GD})}{\rho_L c_L^2} + \frac{\phi_{GD}}{\rho_G c_G^2}\right],$$

where $\phi_{GD}$ is the volume fraction of the gas phases at the discharge, $c_L$ is the speed of sound in the liquid phase, $c_G$ is the speed of sound in the gas phase, $\rho_L$ is the liquid phase density, and $\rho_G$ is the gas phase density.

15. The method according to claim 11, wherein the speed of sound in the fluids entering the ESP is determined by $$\frac{1}{c_I^2} = [(1-\phi_{GI})\rho_L + \phi_{GI}\rho_G]\left[\frac{(1-\phi_{GI})}{\rho_L c_L^2} + \frac{\phi_{GI}}{\rho_G c_G^2}\right],$$

where $\phi_{GI}$ is the volume fraction of the gas phases at the intake, $c_L$ is the speed of sound in the liquid phase, $c_G$ is the speed of sound in the gas phase, $\rho_L$ is the liquid phase density, and $\rho_G$ is the gas phase density.

16. The method according to claim 10, further comprising:

obtaining a pressure-based density of the fluids, and determining the gas content in the fluids using the speed of sound in the fluids and the pressure-based density of the fluids.

17. The method according to claim 10, wherein the speed of sound in the fluids is determined by calculating a time of flight of an acoustic pulse propagating through the fluids.

18. The method according to claim 17, wherein a time of flight is calculated by issuing the acoustic pulse into the fluids, reflecting the acoustic pulse off of a surface, and measuring the time of flight for the reflected acoustic pulse to impinge on an acoustic transducer.

* * * * *